US008339430B2

(12) United States Patent
Choi et al.

(10) Patent No.: US 8,339,430 B2
(45) Date of Patent: Dec. 25, 2012

(54) SINGLE-CHIP DISPLAY-DRIVING CIRCUIT, DISPLAY DEVICE AND DISPLAY SYSTEM HAVING THE SAME

(75) Inventors: Jong-Han Choi, Hwaseong-si (KR); Jae-Goo Lee, Seongnam-si (KR)

(73) Assignee: Samsung Electronics Co., Ltd. (KR)

( * ) Notice: Subject to any disclaimer, the term of this patent is extended or adjusted under 35 U.S.C. 154(b) by 22 days.

(21) Appl. No.: 12/985,912

(22) Filed: Jan. 6, 2011

(65) Prior Publication Data

US 2011/0187755 A1 Aug. 4, 2011

(30) Foreign Application Priority Data

Feb. 1, 2010 (KR) ..... 10-2010-0009253

(51) Int. Cl.
*G09G 5/10* (2006.01)

(52) U.S. Cl. ..... 345/698; 345/84; 345/204

(58) Field of Classification Search ..... 345/84, 345/89, 204, 690, 698, 699
See application file for complete search history.

(56) References Cited

U.S. PATENT DOCUMENTS 6,661,412 B1 * 12/2003 Jun ..... 345/204
2003/0030613 A1 * 2/2003 Chae ..... 345/89
2007/0176951 A1 8/2007 Kato
2007/0242007 A1 * 10/2007 Lee et al. ..... 345/82
2008/0297544 A1 * 12/2008 Huang ..... 345/699
2009/0295768 A1 * 12/2009 Shin et al. ..... 345/204
2009/0316795 A1 * 12/2009 Chui et al. ..... 375/240.25
2010/0026695 A1 * 2/2010 Terada et al. ..... 345/545
2011/0134093 A1 * 6/2011 Chen ..... 345/211

FOREIGN PATENT DOCUMENTS

JP 2007-206231 8/2007
KR 1020050054520 A 6/2005
KR 1020080105672 A 12/2008

* cited by examiner

*Primary Examiner* — Amare Mengistu
*Assistant Examiner* — Premal Patel
(74) *Attorney, Agent, or Firm* — Myers Bigel Sibley & Sajovec, P.A.

(57) ABSTRACT

Display devices include a display driving circuit, which is configured to generate a source driving signal and a gate driving signal in response to image data and horizontal and vertical sync signals. This display driving circuit includes a resolution-type generator, a timing controller, a source driving circuit and a gate driving circuit. The resolution-type generator is configured to generate a resolution-type signal in response to a resolution selecting code and the timing controller is configured to generate first image data, a source driver control signal and a gate driver control signal in response to the resolution-type signal, the image data and the horizontal and vertical sync signals. The source driving circuit is configured to generate the source driving signal in response to grayscale voltages, the first image data and the source driver control signal. The gate driving circuit is configured to generate the gate driving signal in response to the gate driver control signal.

14 Claims, 7 Drawing Sheets

FIG. 3
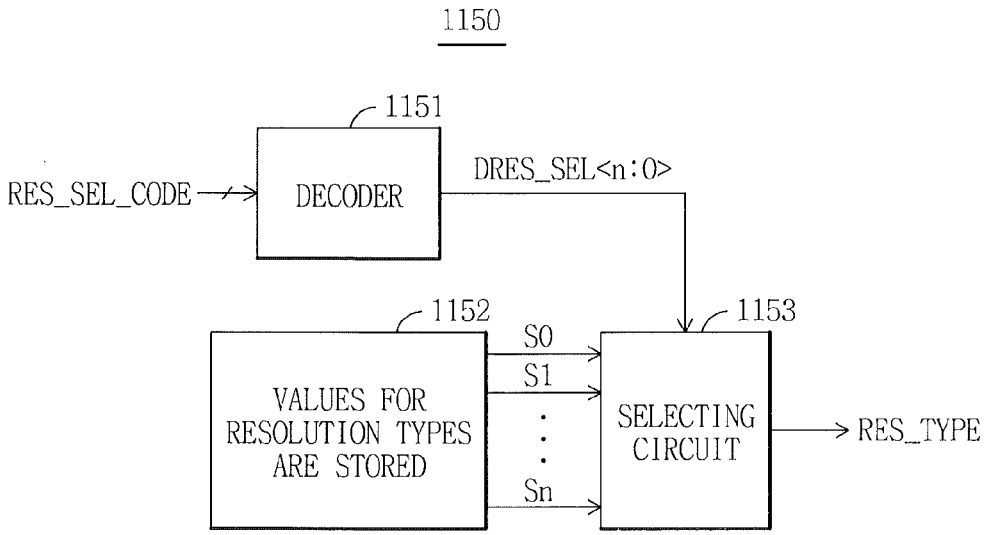
FIG. 4
| RES_SEL_CODE | DRES_SEL | RESOLUTION TYPE |
|---|---|---|
| 00 | 0 | S0 = 360 x 640 |
| 01 | 1 | S1 = 360 x 480 |
| 10 | 2 | S2 = 320 x 480 |
| 11 | 3 | S3 = 240 x 320 |
FIG. 5
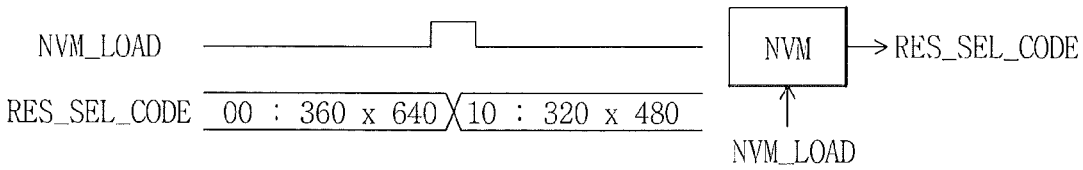

SINGLE-CHIP DISPLAY-DRIVING CIRCUIT, DISPLAY DEVICE AND DISPLAY SYSTEM HAVING THE SAME

REFERENCE TO PRIORITY APPLICATION

This application claims priority to Korean Patent Application No. 10-2010-0009253, filed Feb. 1, 2010, the contents of which are hereby incorporated herein by reference.

FIELD

Embodiments of the inventive concept relate to display devices and, more particularly, to display devices and display systems capable of implementing multi-resolution.

BACKGROUND

Flat panel display devices such as liquid crystal display (LCD) devices and organic light emitting diodes (OLED) are widely used as information processing devices.

Recently, a multi-resolution display device capable of implementing various resolutions for areas of a screen is required. In a conventional display device, a resolution of a display device was set by analyzing an image data or display control signals input from a host. Therefore, software setting in the host was needed in the conventional display device.

Therefore, the conventional display device may have a large chip size and much power consumption because complicated circuits were added to set the resolution of the display device.

SUMMARY

Display devices and systems according to embodiments of the invention include a display driving circuit, which is configured to generate a source driving signal and a gate driving signal in response to image data and horizontal and vertical sync signals. This display driving circuit includes a resolution-type generator, a timing controller, a source driving circuit and a gate driving circuit. Moreover, in the event the display driving circuit is a single-chip display driver circuit, then the display driving circuit may further include an interface circuit configured to buffer the image data and horizontal and vertical sync signals.

The resolution-type generator is configured to generate a resolution-type signal in response to a resolution selecting code and the timing controller is configured to generate first image data, a source driver control signal and a gate driver control signal in response to the resolution-type signal, the image data and the horizontal and vertical sync signals. The source driving circuit is configured to generate the source driving signal in response to grayscale voltages, the first image data and the source driver control signal. The gate driving circuit is configured to generate the gate driving signal in response to the gate driver control signal. These source and gate driving signals may be provided to a display panel.

According to additional embodiments of the invention, the resolution-type generator includes at least a decoder and a selecting circuit. The decoder may be configured to decode the resolution selecting code as a selection control signal and the selecting circuit may be configured to generate the resolution-type signal, by using the selection control signal to select among a plurality of values of resolution types. This resolution selecting code may be stored within a nonvolatile memory. Alternatively, the display driving circuit may include a plurality of input terminals responsive to a plurality of resolution selecting codes.

BRIEF DESCRIPTION OF THE DRAWINGS

Example embodiments are described in further detail below with reference to the accompanying drawings. It should be understood that various aspects of the drawings may have been exaggerated for clarity.

FIG. 3 is a block diagram illustrating an example of a resolution-type generator included in the single-chip display-driving circuit shown in FIG. 2.

FIG. 4 is a table illustrating examples of resolution types that are determined according to a resolution selecting code.

FIG. 5 is a timing diagram illustrating a transition of a resolution selecting code output from a non-volatile memory device.

DETAILED DESCRIPTION OF THE EMBODIMENTS

Figure 1:
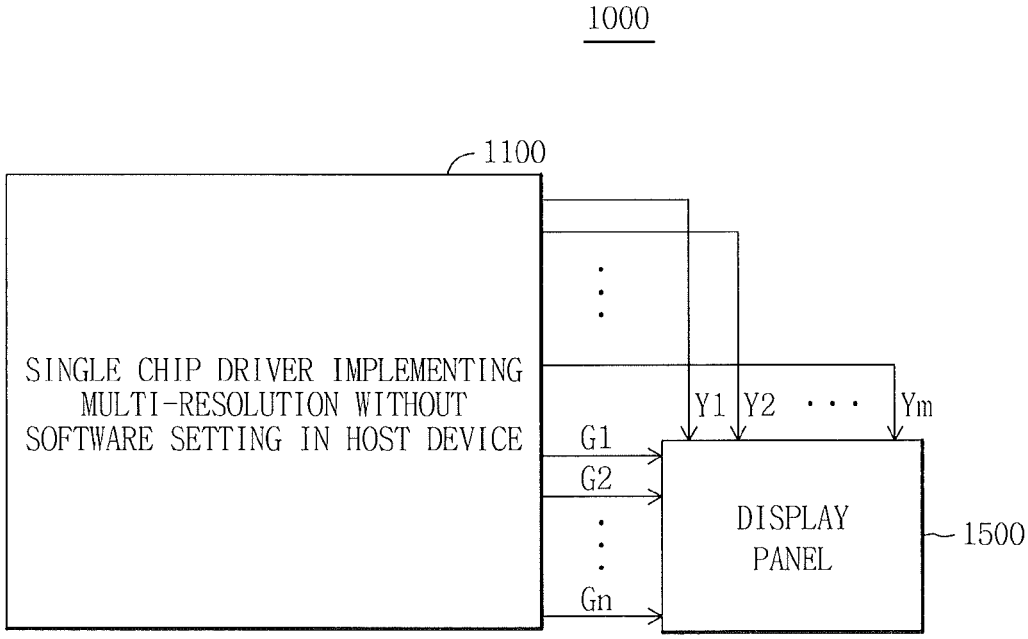
FIG. 1 is a block diagram illustrating a display device according to an example embodiment.

Various example embodiments will now be described more fully with reference to the accompanying drawings in which some example embodiments are shown. In the drawings, the thicknesses of layers and regions may be exaggerated for clarity. Detailed illustrative embodiments are disclosed herein. However, specific structural and functional details disclosed herein are merely representative for purposes of describing example embodiments. This invention, however, may be embodied in many alternate forms and should not be construed as limited to only example embodiments set forth herein. Accordingly, while example embodiments are capable of various modifications and alternative forms, embodiments thereof are shown by way of example in the drawings and will herein be described in detail. It should be understood, however, that there is no intent to limit example embodiments to the particular forms disclosed, but on the contrary, example embodiments are to cover all modifications, equivalents, and alternatives falling within the scope of the invention Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof. Spatially relative terms, such as "beneath," "below," "lower," "above," "upper" and the like, may be used herein for ease of description to describe one element or a relationship between a feature and another element or feature as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, for example, the term "below" can encompass both an orientation which is above as well as below. The device may be otherwise oriented (rotated 90 degrees or viewed or referenced at other orientations) and the spatially relative descriptors used herein should be interpreted accordingly.

Example embodiments are described herein with reference to cross-sectional illustrations that are schematic illustrations of idealized embodiments (and intermediate structures). As such, variations from the shapes of the illustrations as a result, for example, of manufacturing techniques and/or tolerances, may be expected. Thus, example embodiments should not be construed as limited to the particular shapes of regions illustrated herein but may include deviations in shapes that result, for example, from manufacturing. For example, an implanted region illustrated as a rectangle may have rounded or curved features and/or a gradient (e.g., of implant concentration) at its edges rather than an abrupt change from an implanted region to a non-implanted region. Likewise, a buried region formed by implantation may result in some implantation in the region between the buried region and the surface through which the implantation may take place. Thus, the regions illustrated in the figures are schematic in nature and their shapes do not necessarily illustrate the actual shape of a region of a device and do not limit the scope.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved. In order to more specifically describe example embodiments, various aspects will be described in detail with reference to the attached drawings. However, the present invention is not limited to example embodiments described.

FIG. 1 is a block diagram illustrating a display device 1000 according to an example embodiment. Referring to FIG. 1, the display device 1000 includes a single-chip display-driving circuit 1100 and a display panel 1500. The single-chip display-driving circuit 1100 generates a resolution-type signal in response to a resolution selecting code, and generates a source driving signal Y1, Y2, . . . , Ym and a gate driving signal G1, G2, . . . , Gn based on the resolution-type signal, an image data, a horizontal sync signal and a vertical sync signal. The display panel 1500 operates in response to the source driving signal Y1, Y2, . . . , Ym and the gate driving signal G1, G2, . . . , Gn.

Figure 2:
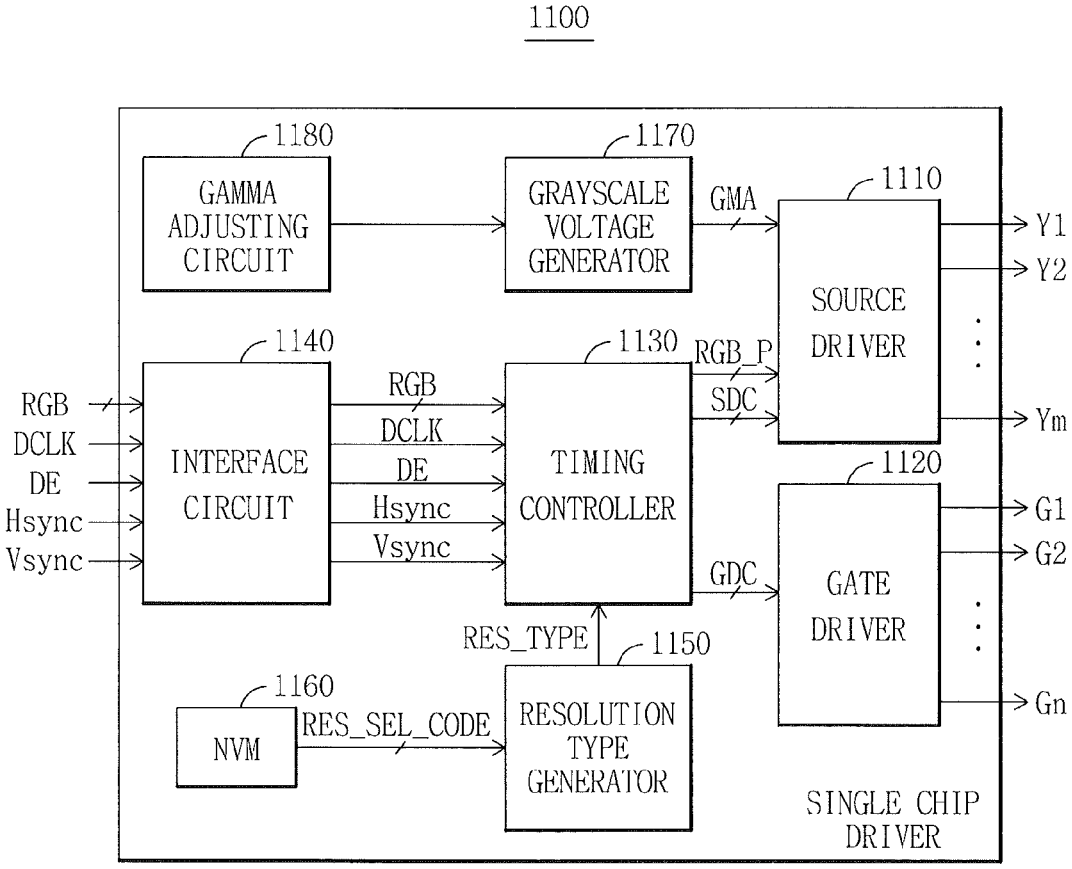
FIG. 2 is a block diagram illustrating an example of a single-chip display-driving circuit included in the display device shown in FIG. 1.

FIG. 2 is a block diagram illustrating an example of a single-chip display-driving circuit 1100 included in the display device 1000 shown in FIG. 1. Referring to FIG. 2, the single-chip display-driving circuit 1100 includes a source driving circuit 1110, a gate driving circuit 1120, a timing controller 1130, an interface circuit 1140, a resolution-type generator 1150, a non-volatile memory circuit 1160, a grayscale voltage generator 1170 and a gamma adjusting circuit 1180.

The resolution-type generator 1150 generates a resolution-type signal RES_TYPE in response to a resolution selecting code RES_SEL_CODE. The timing controller 1130 generates a first image data RGB_P, a source driver control signal SDC and a gate driver control signal GDC suitable for a resolution of a display panel based on the resolution-type signal RES_TYPE, an image data RGB, a clock signal DCLK, a data enable signal DE, a horizontal sync signal H_sync and a vertical sync signal V_sync. The source driving circuit 1110 generates the source driving signal Y1, Y2, . . . , Ym based on grayscale voltages GMA, the first image data RGBP, and the source driver control signal SDC. The gate driving circuit 1120 generates a gate driving signal G1, G2, . . . , Gn based on the gate driver control signal GDC.

The resolution selecting code RES_SEL_CODE may be stored in the non-volatile memory circuit 1160 and then output to the resolution-type generator 1150 when the load signal is enabled. The non-volatile memory circuit 1160 may be formed in the single-chip display-driving circuit 1100 using a semiconductor fabrication process.

The interface circuit 1140 buffers the image data RGB, the clock signal DCLK, the data enable signal DE, the horizontal sync signal H_sync and the vertical sync signal V_sync to provide the buffered image data, the buffered horizontal sync signal and the buffered vertical signal to the timing controller 1130. The grayscale voltage generator 1170 generates the grayscale voltages GMA having positive polarity and negative polarity related to a brightness of a display device. The gamma adjusting circuit 1180 may adjust gamma vales of the grayscale voltages GMA.

FIG. 3 is a block diagram illustrating an example of a resolution-type generator 1150 included in the single-chip display-driving circuit 1100 shown in FIG. 2. Referring to FIG. 3, the resolution-type generator 1150 may include a decoder 1151, a memory circuit 1152 and a selecting circuit 1153. The decoder 1151 decodes the resolution selecting code RES_SEL_CODE to generate a selection control signal DRES_SEL. The memory circuit 1152 stores values S0 to Sn of resolution types and may be comprised of registers. The selecting circuit 1153 selects the values of resolution types in response to the selection control signal DRES_SEL to generate the resolution-type signal RES_TYPE. The values S0 to Sn of resolution types stored in the memory circuit 1152 may be used in a range control of write/read/scan, a source amplifier control, a gate driver control, a common voltage control, a horizontal timing control, a vertical timing control or a power setting.

FIG. 4 is a table illustrating examples of resolution types that are determined according to a resolution selecting code. Referring to FIG. 4, the resolution selecting code RES_SEL_CODE is a signal having two data bits (0 or 1), and may have four values 00, 01, and 11. When the resolution selecting code RES_SEL_CODE is "00", the selection control signal DRES_SEL may have a value of "0", and the resolution type may be S0 (=360*640). The resolution selecting code RES_SEL_CODE is "01", the selection control signal DRES_SEL may have a value of "1", and the resolution type may be S1 (=360*480). The resolution selecting code RES_SEL_CODE is "10", the selection control signal DRES_SEL may have a value of "2", and the resolution type may be S2 (=320*480). The resolution selecting code RES_SEL_CODE is "11", the selection control signal DRES_SEL may have a value of "3", and the resolution type may be S3 (~240*320). For example, S0 (=360*640) may have 640 lines in a horizontal direction and 360 pixels in a vertical direction. That is, a display panel of the display device whose resolution type is S0 (=360*640) may have 360 pixels per each of 640 lines. S0 (=360*640) may be a resolution of nHD grade and S2 (=320*480) may be a resolution of HVGA grade.

FIG. 5 is a timing diagram illustrating a transition of a resolution selecting code output from the non-volatile memory device 1160. Referring to FIG. 5, the non-volatile memory device 1160 outputs the resolution selecting code RES_SEL_CODE in response to a load signal NVM_LOAD. In FIG. 5, a process in which the resolution selecting code RES_SEL_CODE changes from "00" to "10".

Figure 6:
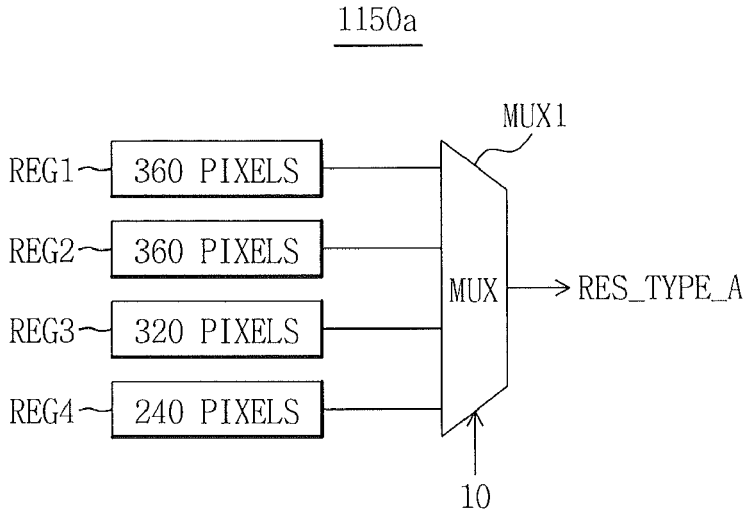
FIG. 6 and FIG. 7 are circuit diagrams illustrating examples of selecting the number of pixels in a vertical direction and the number of lines in a horizontal direction independently.
Figure 7:
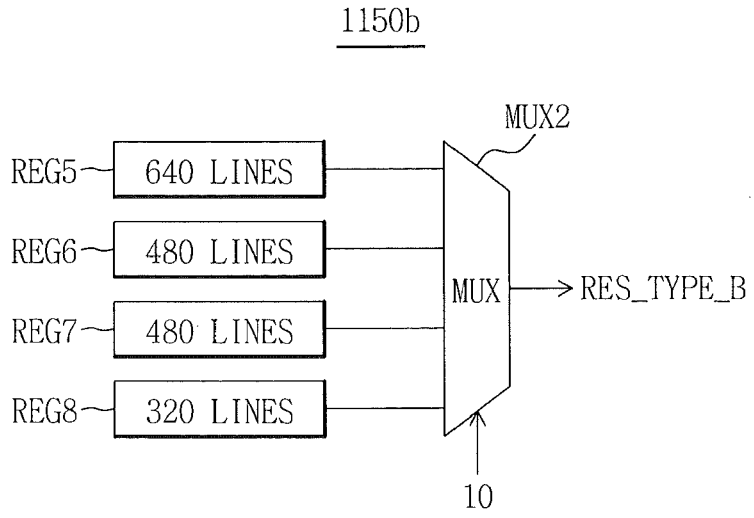

FIG. 6 and FIG. 7 are circuit diagrams illustrating examples of selecting the number of pixels in a vertical direction and the number of lines in a horizontal direction independently. That is, FIG. 6 and FIG. 7 may be applied to a display device including a resolution-type generator 1150 having a vertical resolution type generator and a horizontal resolution type generator. FIG. 6 illustrates a first resolution type generator 1150*a* that selects the number of pixels in a vertical direction, and FIG. 7 illustrates a second resolution type generator 1150*b* that selects the number of lines in a horizontal direction.

Referring to FIG. 6, the first resolution type generator 1150*a* stores the number of pixels in a vertical direction of values of resolution S0, S1, S2 and S3 in registers REG1, REG2, REG3 and REG4, and selectively outputs the values stored in the registers REG1, REG2, REG3 and REG4 as a first resolution type signal RES_TYPE_A in response to the resolution selecting code RES_SEL_CODE using a multiplexer MUX1. For example, when the resolution selecting code RES_SEL_CODE is "10, 320 pixels stored in the register REG3 may be output as the first resolution type signal RES_TYPE_A.

Referring to FIG. 7, the second resolution type generator 1150*b* stores the number of lines in a horizontal direction of values of resolution S0, S1, S2 and S3 in registers REG5, REG6, REG7 and REG8, and selectively outputs the values stored in the registers REG5, REG6, REG7 and REG8 as a second resolution type signal RES_TYPE_B in response to the resolution selecting code RES_SEL_CODE using a multiplexer MUX2. For example, when the resolution selecting code RES_SEL_CODE is "10, 480 lines stored in the register REG7 may be output as the second resolution type signal RES_TYPE_B.

Figure 8:
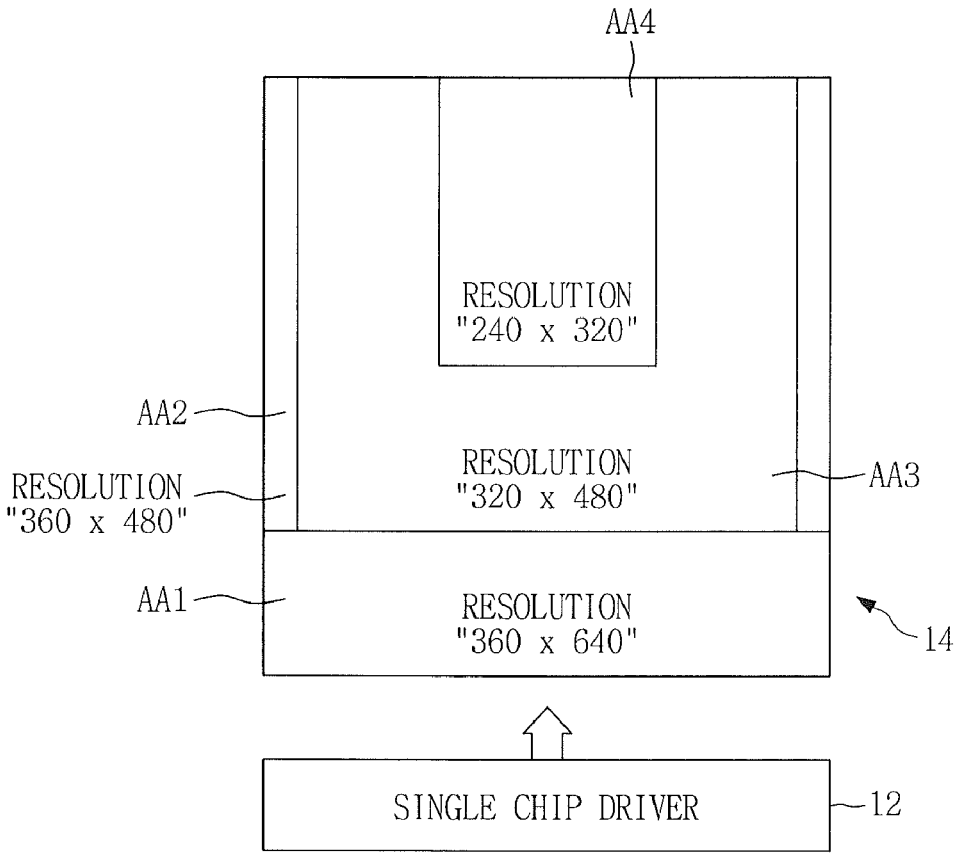
FIG. 8 is a diagram illustrating an example of a display panel having different resolutions with respect to areas in response to an output of a single-chip driving circuit.

FIG. 8 is a diagram illustrating an example of a display panel 14 having different resolutions with respect to areas in response to an output of a single-chip driving circuit 12. Referring to FIG. 8, the display panel 14 includes a plurality of areas AA1, AA2, AA3 and AA4. The single-chip driving circuit 12 may set a resolution so that each of the areas AA1, AA2, AA3 and AA4 of the display panel 14 has different resolution from one another. For example, the resolution of AA1 may be set to 360*640, the resolution of AA2 may be set to 360*480, the resolution of AA3 may be set to 320*480, and the resolution of AA4 may be set to 240*320. The single-chip driving circuit 12 may have a circuit structure of FIG. 2, and may set itself the resolution of a panel of the single-chip driving circuit 12 in response to the resolution selecting code RES_SEL_CODE.

Figure 9:
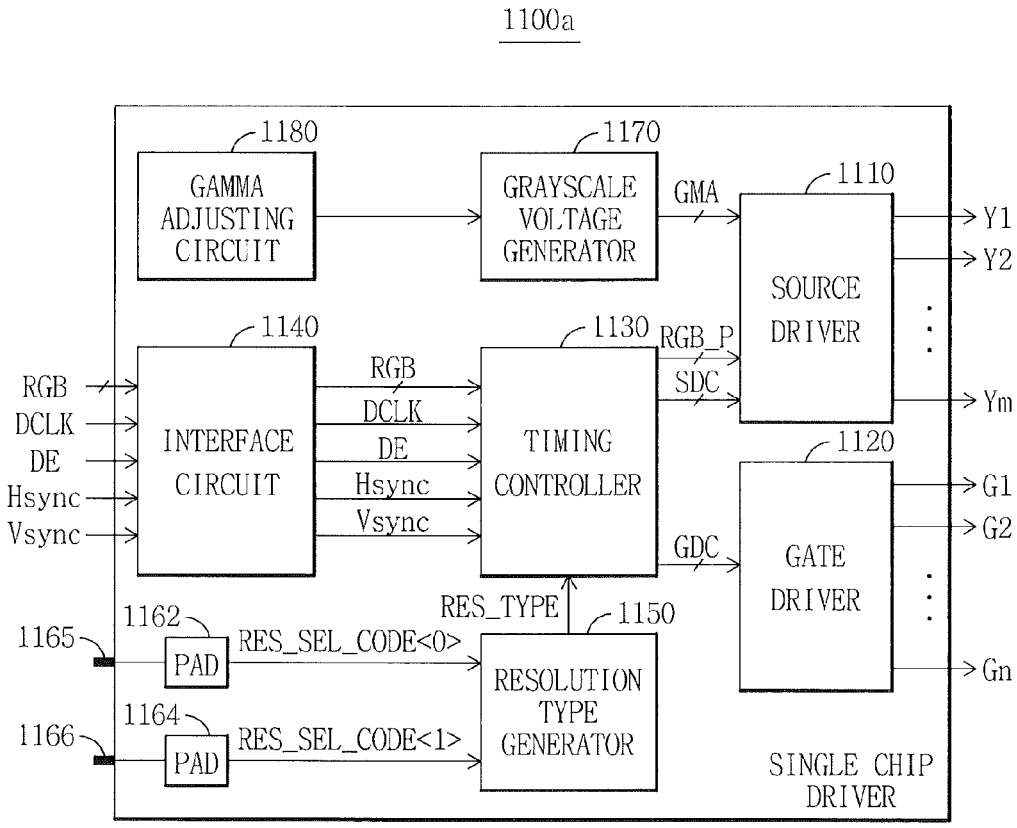
FIG. 9 is a block diagram illustrating another example of a single-chip display-driving circuit included in the display device shown in FIG. 1.

FIG. 9 is a block diagram illustrating another example of a single-chip display-driving circuit 1100 included in the display device 1000 shown in FIG. 1. Referring to FIG. 9, the single-chip display-driving circuit 1100*a* includes a source driving circuit 1110, a gate driving circuit 1120, a timing controller 1130, an interface circuit 1140, a resolution-type generator 1150, pads 1162 and 1164, a grayscale voltage generator 1170 and a gamma adjusting circuit 1180. The resolution-type generator 1150 generates a resolution-type signal RES_TYPE in response to a resolution selecting code RES_SEL_CODE. The timing controller 1130 generates a first image data RGB_P, a source driver control signal SDC and a gate driver control signal GDC suitable for a resolution of a display panel based on the resolution-type signal RES_TYPE, an image data RGB, a clock signal DCLK, a data enable signal DE, a horizontal sync signal H_sync and a vertical sync signal V_sync. The source driving circuit 1110 generates the source driving signal Y1, Y2, . . . , Ym based on grayscale voltages GMA, the first image data RGB_P, and the source driver control signal SDC. The gate driving circuit 1120 generates a gate driving signal G1, G2, . . . , Gn based on the gate driver control signal GDC. The resolution selecting code RES_SEL_CODE may be input from an exterior of a display-driving chip to an interior of the display-driving chip through the pads 1162 and 1164.

In an example of FIG. 9, a first bit RES_SEL_CODE<0> of the resolution selecting code RES_SEL_CODE is received through a first pad 1162, and a second bit RES_SEL_CODE<1> of the resolution selecting code RES_SEL_CODE is received through a second pad 1164. The first pad 1162 communicates with the exterior of the chip through a first pin 1165, and the second pad 1164 communicates with the exterior of the chip through a second pin 1166. Hereinafter, operations of a single-chip display-driving circuit and a display device including the single-chip display-driving circuit according to example embodiments will be described referring to FIGS. 1 to 9. The display device 1000 according to example embodiments may set itself a plurality of resolutions without software setting in a host.

Referring to FIG. 2, the single-chip display-driving circuit 1100 includes the resolution-type generator 1150 that generates a resolution-type signal RES_TYPE in response to a resolution selecting code RES_SEL_CODE. As shown in FIG. 3, the resolution-type generator 1150 includes the decoder 1151, the memory circuit 1152 and the selecting circuit 1153. The resolution-type generator 1150 decodes the resolution selecting code RES_SEL_CODE to generate a selection control signal DRES_SEL, and selects the values of resolution types S0 to Sn in response to the selection control signal DRES_SEL to generate the resolution-type signal RES_TYPE. The timing controller 1130 generates a first image data RGB_P suitable for a resolution of a display panel based on the resolution-type signal RES_TYPE, and provide the first image data RGB_P to the source driving circuit 1110.

The display device 1000 including the single-chip display-driving circuit 1100 according to example embodiments does not analyze image data received from a host, but selectively outputs the resolution-type signal RES_TYPE using the resolution selecting code RES_SEL_CODE. The resolution selecting code RES_SEL_CODE may be stored in the non-volatile memory device 1160 which is formed in the single-chip display-driving circuit 1100 using a semiconductor fabrication process as shown in FIG. 2, and may be provided to the resolution-type generator 1150 when the load signal NVM_LOAD in FIG. 5 is enabled. Further, the resolution selecting code RES_SEL_CODE may be input from an exterior of a display-driving chip to an interior of the display-driving chip through the pads 1162 and 1164 formed in the single-chip display-driving circuit 1100.

As shown in FIG. 8, the single-chip display-driving circuit 1100 may drive the display panel so that each area of the display panel has different resolution one another. Therefore, the single-chip display-driving circuit 1100 may set itself a plurality of resolutions without software setting in a host.

Figure 10:
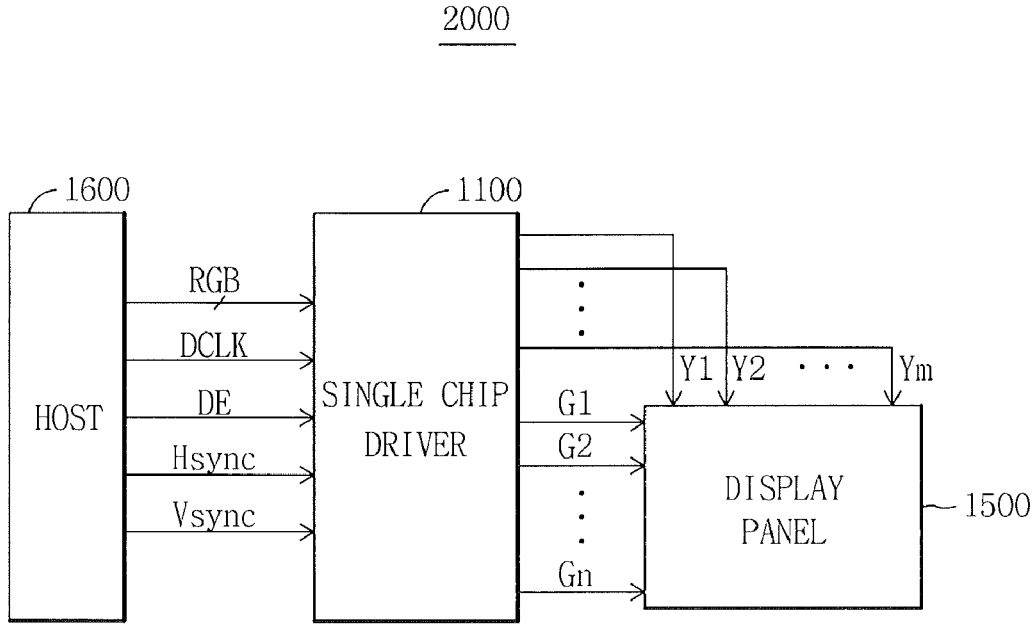
FIG. 10 is a block diagram of a display system having a single-chip display-driving circuit according to example embodiments.

FIG. 10 is a block diagram of a display system 2000 having a single-chip display-driving circuit 1100 according to example embodiments. The display system 2000 including a host 1600, a single-chip display-driving circuit 1100 and a display panel 1500. The host 1600 generates an image data RGB, a clock signal DCLK, a data enable signal DE, a horizontal sync signal Hsync and a vertical sync signal Vsync. The single-chip display-driving circuit 1100 generates a resolution-type signal in response to a resolution selecting code, and generates a source driving signal Y1, Y2, . . . , Ym and a gate driving signal G1, G2, . . . , Gn based on the resolution-type signal, the image data, the horizontal sync signal Hsync and the vertical sync signal Vsync. The display panel 1500 operates in response to the source driving signal Y1, Y2, . . . , Ym and the gate driving signal G1, G2, . . . , Gn. The host 1600 may be a processor chip of a mobile communication terminal or a main body of a computer system. The single-chip display-driving circuit 1100 according to example embodiments may be applied to a flat panel display device such as LCD device and PDP device. In particular, the single-chip display-driving circuit according to example embodiments is suitable for driving mobile devices such as a cellular phone.

Referring to FIGS. 1 to 9, a method of driving a display device using a single-chip display-driving circuit includes the following steps:

1) receive an image data, a horizontal sync signal and a vertical sync signal from a host;

2) generate a resolution-type signal in response to a resolution selecting code;

3) generate a first image data, a source driver control signal and a gate driver control signal suitable for a resolution of a display panel based on the resolution-type signal, the image data, the horizontal sync signal and the vertical sync signal;

4) generate a source driving signal based on grayscale voltages, the first image data, the source driver control signal; and 5) generate a gate driving signal based on the gate driver control signal.

The method of driving a display device according to example embodiments may set the resolution of the display panel without software setting in a host, and set the resolution of the display panel so that the display panel has different resolutions with respect to panel areas. The resolution selecting code may be output from a non-volatile memory circuit when a load signal is enabled. The non-volatile memory circuit may be formed be formed in the single-chip display-driving circuit. The resolution selecting code may be input from an exterior of a display-driving chip to an interior of the display-driving chip through a pad.

The foregoing is illustrative of example embodiments and is not to be construed as limiting thereof. Although a few example embodiments have been described, those skilled in the art will readily appreciate that many modifications are possible in example embodiments without materially departing from the novel teachings and advantages. Accordingly, all such modifications are intended to be included within the scope of this invention as defined in the claims. In the claims, means-plus-function clauses are intended to cover the structures described herein as performing the recited function, and not only structural equivalents but also equivalent structures. Therefore, it is to be understood that the foregoing is illustrative of various example embodiments and is not to be construed as limited to the specific embodiments disclosed, and that modifications to the disclosed embodiments, as well as other embodiments, are intended to be included within the scope of the appended claims.

What is claimed is:

1. A display device, comprising:

a display driving circuit configured to generate a source driving signal and a gate driving signal in response to image data and horizontal and vertical sync signals, said display driving circuit comprising:

a resolution-type generator configured to generate a resolution-type signal in response to a resolution selecting code, said resolution-type generator comprising a decoder configured to decode the resolution selecting code as a selection control signal and a selecting circuit configured to generate the resolution-type signal using the selection control signal to select among a plurality of values of resolution types;

a timing controller configured to generate first image data, a source driver control signal and a gate driver control signal in response to the resolution-type signal, the image data and the horizontal and vertical sync signals;

a source driving circuit configured to generate the source driving signal in response to grayscale voltages, the first image data and the source driver control signal; and a gate driving circuit configured to generate the gate driving signal in response to the gate driver control signal.

2. The display device of claim 1, further comprising a display panel responsive to the source and gate driving signals.

3. The display device of claim 1, wherein said display driving circuit further comprises a nonvolatile memory configured to store the resolution selecting code.

4. The display device of claim 1, wherein said display driving circuit further comprises a plurality of input terminals responsive to a plurality of resolution selecting codes.

5. The display device of claim 1, wherein said display driving circuit is a single-chip display driver circuit comprising an interface circuit configured to buffer the image data and horizontal and vertical sync signals.

6. A single-chip display-driving circuit, comprising:

a resolution-type generator configured to generate a resolution-type signal in response to a resolution selecting code, said resolution-type generator comprising:

a decoder configured to decode the resolution selecting code to generate a selection control signal;

a memory circuit in which values of resolution types are stored; and a selecting circuit configured to selectively output the values of resolution types in response to the selection control signal;

a timing controller configured to generate a first image data, a source driver control signal and a gate driver control signal suitable for a resolution of a display panel based on the resolution-type signal, an image data, a horizontal sync signal and a vertical sync signal;

a source driving circuit configured to generate a source driving signal based on grayscale voltages, the first image data and the source driver control signal; and a gate driving circuit configured to generate a gate driving signal based on the gate driver control signal.

7. The single-chip display-driving circuit of claim 6, configured to set the resolution of the display panel so that the display panel has different resolutions with respect to panel areas.

8. The single-chip display-driving circuit of claim 6, wherein the resolution selecting code is configured to be provided to the resolution-type generator from a non-volatile memory circuit when a load signal is enabled.

9. The single-chip display-driving circuit of claim 8, wherein the non-volatile memory circuit is configured to be formed in the single-chip display-driving circuit using a semiconductor fabrication process.

10. The single-chip display-driving circuit of claim 6, wherein the resolution selecting code is configured to be input from an exterior of the single-chip display-driving circuit to an interior of the single-chip display-driving circuit through a pad.

11. The single-chip display-driving circuit of claim 6, wherein the memory circuit includes a register.

12. The single-chip display-driving circuit of claim 6, further comprising an interface circuit configured to buffer the image data, the horizontal sync signal and the vertical sync signal to provide the buffered image data, the buffered horizontal sync signal and the buffered vertical signal to the timing controller.

13. The single-chip display-driving circuit of claim 6, further comprising a grayscale voltage generator for generating the grayscale voltages.

14. A display device, comprising:

a single-chip display-driving circuit configured to generate a resolution-type signal in response to a resolution selecting code, and generate a source driving signal and a gate driving signal based on the resolution-type signal, an image data, a horizontal sync signal and a vertical sync signal, said single-chip display-driving circuit including a resolution-type generator that comprises a decoder configured to decode the resolution selecting code as a selection control signal and a selecting circuit configured to generate the resolution-type signal using the selection control signal to select among a plurality of values of resolution types; and a display panel configured to operate in response to the source driving signal and the gate driving signal.

* * * * *